US006644456B2

(12) United States Patent
Trenner

(10) Patent No.: US 6,644,456 B2
(45) Date of Patent: Nov. 11, 2003

(54) ELECTRONIC COIN CHECKER

(75) Inventor: Dietmar Trenner, Berlin (DE)

(73) Assignee: Walter Hanke Mechanische Werstätten GmbH & Co. KG (DE)

( * ) Notice: Subject to any disclaimer, the term of this patent is extended or adjusted under 35 U.S.C. 154(b) by 40 days.

(21) Appl. No.: 09/862,630

(22) Filed: May 22, 2001

(65) Prior Publication Data

US 2002/0000358 A1 Jan. 3, 2002

(30) Foreign Application Priority Data

May 22, 2000 (DE) ..... 100 27 723

(51) Int. Cl.[7] ..... G07D 5/08

(52) U.S. Cl. ..... 194/346; 194/321; 194/344; 194/345

(58) Field of Search ..... 194/345, 346, 194/321, 344

(56) References Cited

U.S. PATENT DOCUMENTS

| | | | | | |
|---|---|---|---|---|---|
| 2,669,337 | A | * | 2/1954 | Stewart | 194/345 |
| 3,163,278 | A | * | 12/1964 | Rounsivell | 194/328 |
| 3,916,922 | A | * | 11/1975 | Prumm | 194/346 |
| 4,089,400 | A | * | 5/1978 | Gregory, Jr. | 194/329 |
| 4,582,189 | A | * | 4/1986 | Schmitt | 194/317 |
| 4,706,795 | A | * | 11/1987 | Mikami et al. | 194/317 |
| 5,316,120 | A | * | 5/1994 | Ibarrola | 194/318 |
| 5,476,168 | A | | 12/1995 | Malzard et al. | |
| 5,788,047 | A | * | 8/1998 | Chung | 194/318 |
| 6,098,778 | A | * | 8/2000 | Yeh | 194/318 |
| 6,112,876 | A | * | 9/2000 | Juds et al. | 194/344 |
| 2001/0040081 | A1 | * | 11/2001 | Smith et al. | 254/42 |

FOREIGN PATENT DOCUMENTS

| | | |
|---|---|---|
| DE | 42 44 870 C 2 | 10/1993 |
| EP | 0 042 662 A 1 | 12/1981 |
| EP | 0 086 583 A 2 | 8/1983 |
| GB | 2 232 286 A | 5/1990 |

* cited by examiner

*Primary Examiner*—Kathy Matecki
*Assistant Examiner*—Sang Kim
(74) *Attorney, Agent, or Firm*—Young & Basile, P.C.

(57) ABSTRACT

An electronic coin checker is proposed which has a coin entry channel, in the region of which a sensor arrangement is disposed, and has a flap-shaped coin switch and a control device. In dependence on the signals of the sensor arrangement, the control device controls the coin switch to accept a coin running through the coin entry channel into an acceptance shaft, or into a return channel to return the coin. The flap-shaped coin switch has a sloping extension inclined towards the runway of the return channel, on which the coin slides away in the return position of the switch, alters its inclination and falls onto the runway of the return channel. The boundary wall, lying opposite the coin switch, of the return channel is configured inclined in the running direction, and thus a further alteration in inclination takes place.

27 Claims, 7 Drawing Sheets

ELECTRONIC COIN CHECKER

BACKGROUND OF THE INVENTION

The invention relates to an electronic coin checker which has a coin entry channel, in the region of which a sensor arrangement is provided, and has a flap-shaped coin switch which is controlled by a control device in dependence on sensor signals into an acceptance and a return position.

A large number of coin checkers are known in prior art, which all have in common the fact that in the region of the coin entry channel, which communicates with the coin slot, a sensor arrangement is provided which checks that the coin is genuine and admissible. Here one or more sensors are disposed in the region of the coin entry channel, which sensors can be configured inductive, capacitive, optical, optoelectronic, piezoelectric or the like and which supply an electrical signal which is processed by an electronic control and evaluation unit.

In dependence on the sensor signals, coin paths are freed by means of coin switches or coin guiding devices, via which paths the coins are accepted or, in the case of rejected coins, returned.

Such an electronic coin checker is known for example from DE 42 44 870. In this coin checker, the coin to be checked falls, after the coin entry channel and after being checked by the sensor arrangement, through a gap onto a lower sloping guide device inclined in the opposite direction, the sloping guide device being formed by sloping end faces of switch tongues. At the end of the sloping guide device is located a fall shaft which is freed by the switch tongues in their inactive position and which serves to return rejected coins. If the coin to be checked is accepted, the switch tongue corresponding to the checked coin value is activated and the activated switch tongue, provided with the sloping end face, is pivoted out of the sloping guide device, such that the coin is accepted. Electronic coin checkers are generally designed to check a large number of different coins, such that a plurality of switch tongues or flaps or guiding elements are provided to guide the different accepted coins into the corresponding collecting device.

Furthermore in prior art mechanical coin checkers are known in which mechanic and/or permanent-magnetic sensor and checking elements are provided in the region of the coin entry channel. Generally the mechanical sensor and checking elements are so set that they only check one type of coin for its validity, and one acceptance and one return shaft are present. Mechanical coin checkers are usually relatively deep in order to render more difficult manipulation aimed at guiding back coins.

SUMMARY OF THE INVENTION

It has now become apparent that it would be desirable to replace a mechanical coin checker by a simple electronic coin checker since the latter can be built more inexpensively and can be set more simply for different types of coin. If mechanical coin checkers are to be replaced by electronic ones, the dimensions of the electronic coin checkers must correspond to those of the mechanical coin checkers. The result of this is that the inclination of the coin entry channel and of the corresponding return channel must be made smaller than in those of the mechanical coin checkers since the mechanical coin checkers have a shorter measurement path in comparison with electronic coin checkers, and thus the coin drops more steeply into the return path. The long measurement path in electronic coin checkers is due to the fact that more measurement parameters are present.

The object underlying the invention, taking prior art into account, is to create an electronic coin checker that has the dimensions of a mechanical coin checker and thus can replace the same and which is suitable for all sizes of coins (up to approximately 33 mm) and in which the coins, despite the coin paths having a very small angle of inclination, do not for example stop at the dead point of the diversion and run at a relatively uniform speed smoothly over the coin track, especially that of the return channel. This object is accomplished according to the subject invention.

Because the electronic coin checker has at the end of the coin entry channel a deflecting device for rejected coins, which alters the coin twice in its inclination or direction, even for large coins up to 33 mm the deflection difficulties are overcome and no "dead point" is produced at which the coin stops. Here the deflecting device comprises the combination of an inclined extension which is integrally molded onto the flap-shaped coin switch and which is inclined in the direction towards the runway of the return channel, and the boundary wall of the return channel, said wall being inclined in the running direction of the coin.

In an advantageous manner, a flap covering the coin checking path can be easily opened by actuation from outside, such that blocked coins slide into a further return channel which is disposed parallel to the first return channel.

BRIEF DESCRIPTION OF THE DRAWINGS

An embodiment of the invention is shown in the drawing and is explained in greater detail in the following description. The figures show.

DESCRIPTION OF THE PREFERRED EMBODIMENT

Figure 1:
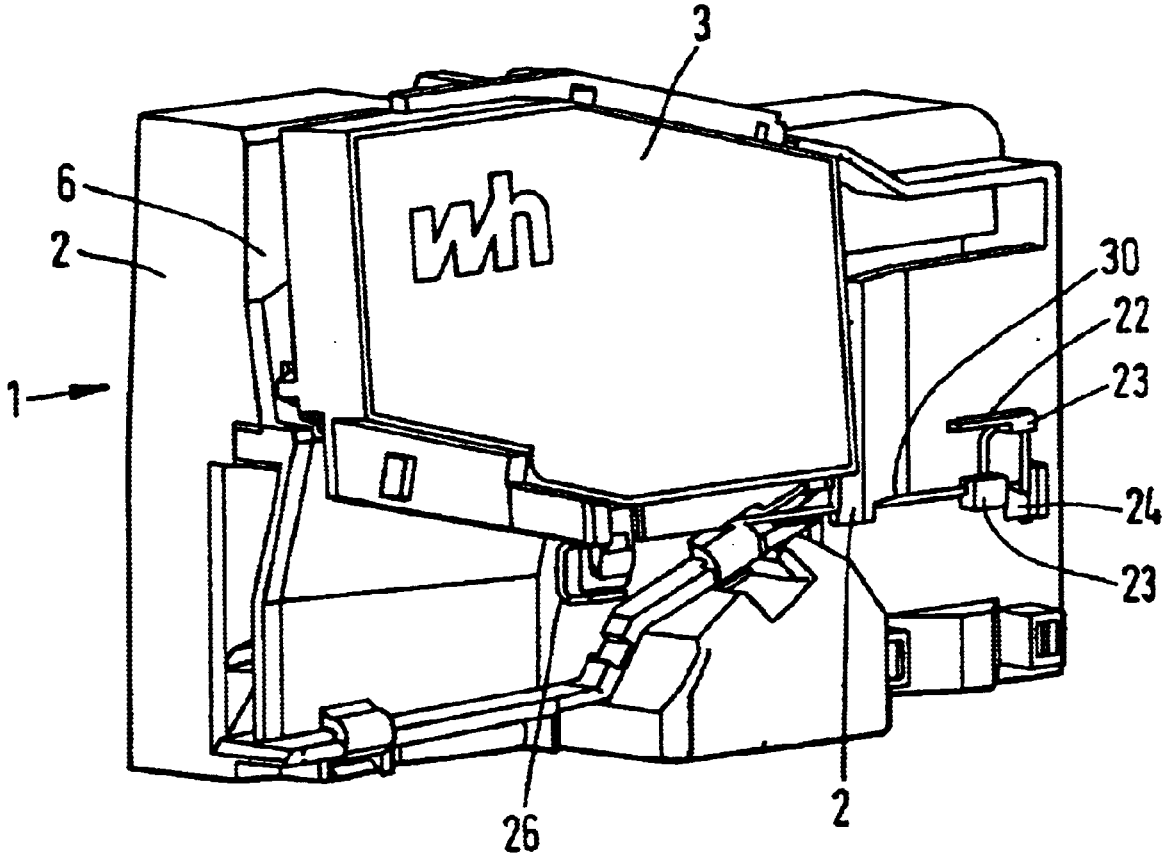
FIG. 1 a perspective view of the electronic coin checker according to the present invention, FIG. 2 a perspective view of the coin checker according to the invention with opened covering flap, FIG. 3 a perspective partial view of the coin checker without flap, with coins in a different position respectively before and after coin checking, FIG. 4 a perspective view of the coin checker according to the invention, without the back wall and with a coin in different positions after checking, FIG. 5 a further perspective view of a portion of the coin checker substantially from the front with different positions of a coin, FIG. 6 a perspective partial view of a coin with the coin switch in a first position, FIG. 7 perspective views of a coin in relation to the coin switch and the coin return channel in a second position of the coin, FIG. 8 perspective views of the coin in relation to the coin switch and the return channel in a third position, FIG. 9 a perspective view of a further embodiment of a coin checker with the flap closing mechanism.
Figure 2:
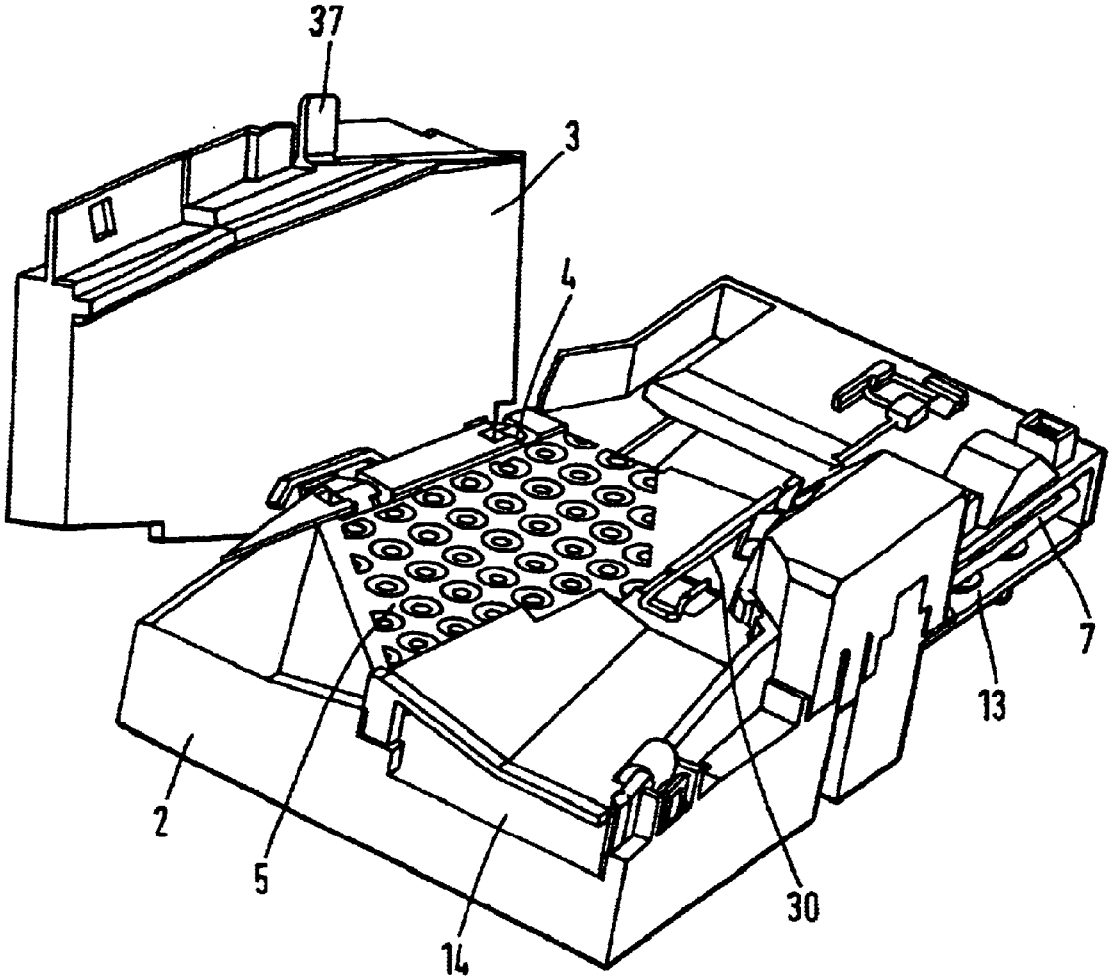

In FIGS. 1 and 2 is represented an electronic coin checker in the closed state and in the open state provided for cleaning. The coin checker 1 has a housing base 2, on which a covering flap 3 is pivotably disposed via hinges 4. Through the wall of the housing base and the covering flap 3 is formed a coin entry channel S which is accessible from the outside via a coin slot 6. The coin slot 6 is located in the front end face of the coin checker 1 and serves the insertion of coins. In the region of the coin entry channel 5 are provided in the housing base 2 and/or in the covering flap 3 sensors of a coin checking device which are not shown in detail in the figures. These sensors are connected to a control and evaluation unit, also not shown, which carries out in dependence on the sensor signals checking of the validity of the inserted coins.

Figure 3:
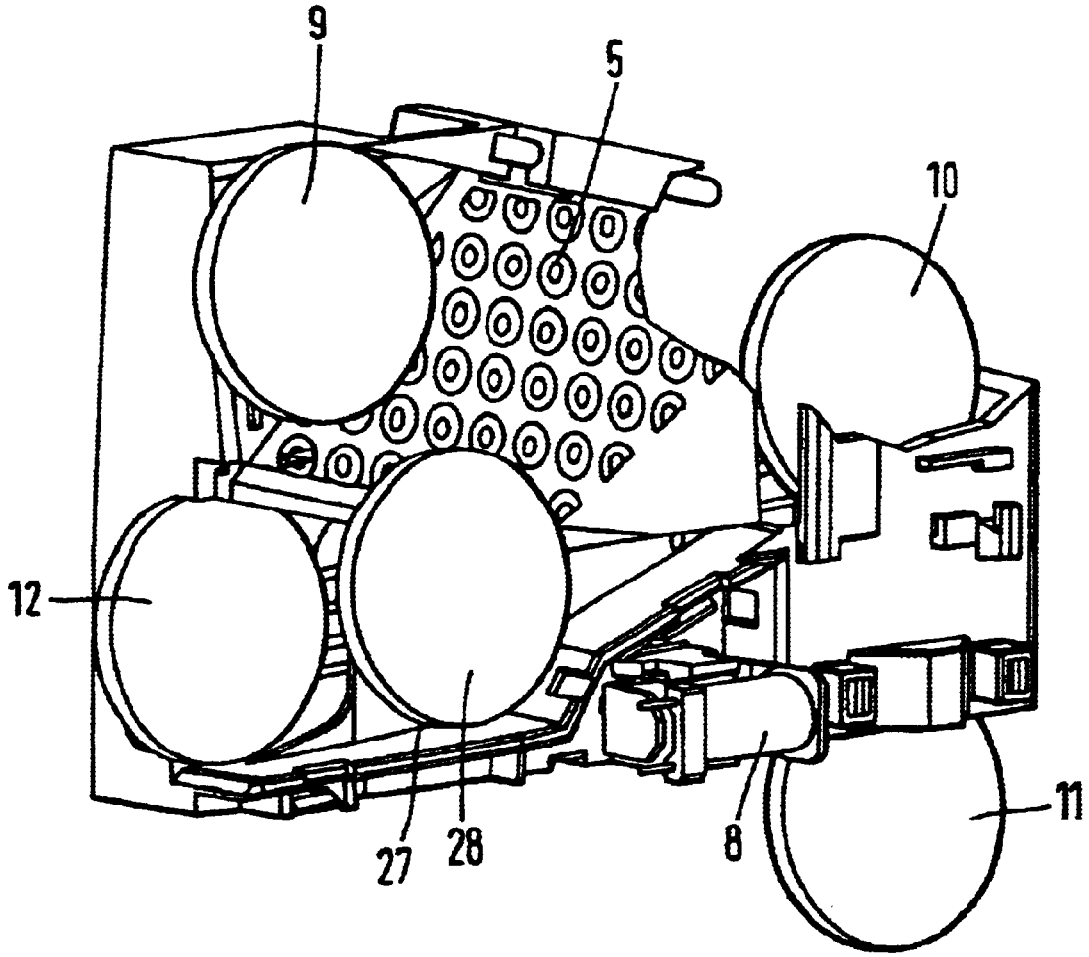
Figure 4:
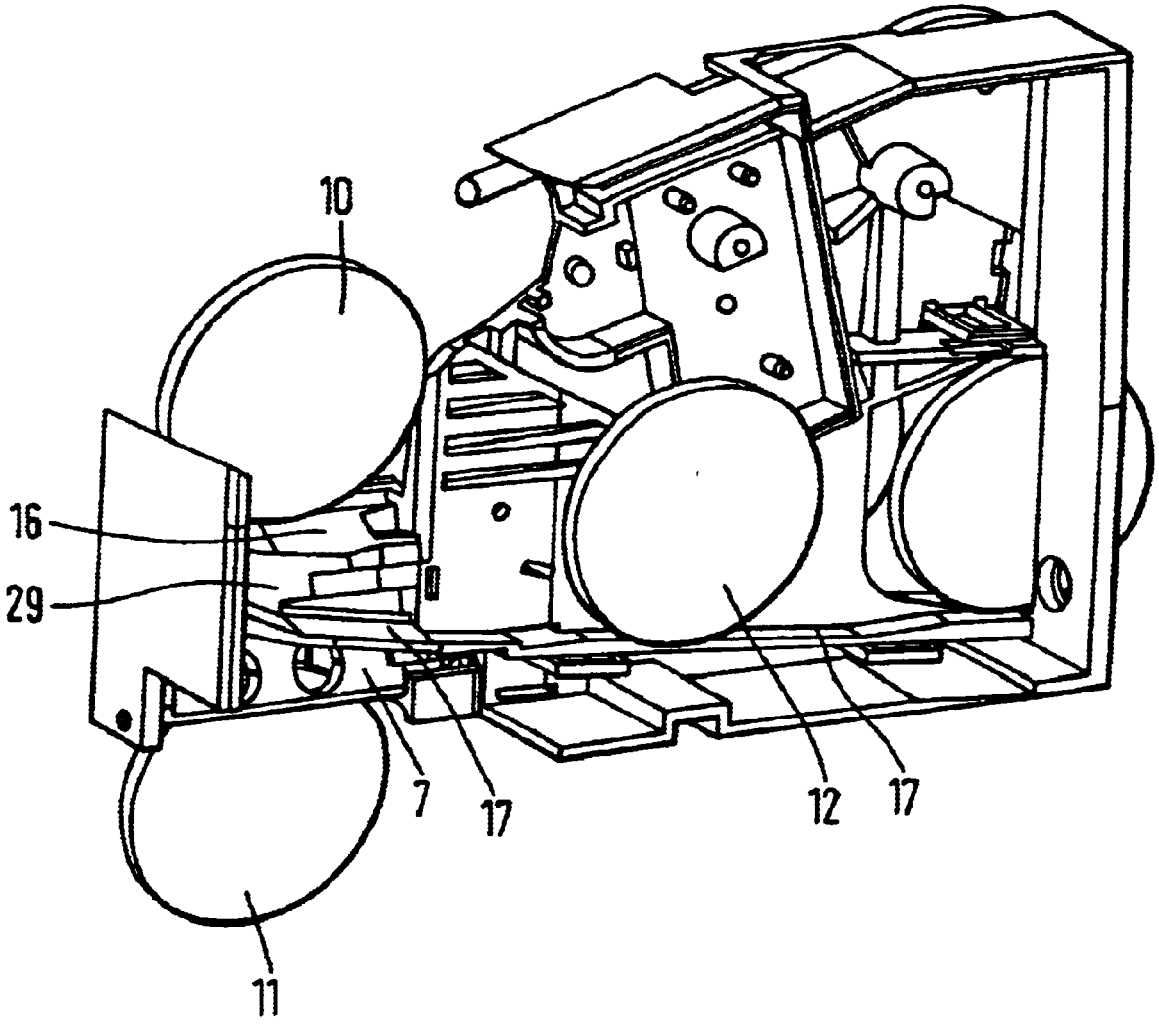

At the end of the coin entry channel 5 is provided a flap-shaped coin switch 7 which can only be seen as an indication in FIG. 2 and is covered in FIG. 1 by the housing. The flap-shaped coin switch 7 is controlled by the control device via an electromagnet 8 represented in FIG. 3, and can assume two positions, namely the acceptance position and the return position. In FIG. 3 are represented different positions of a coin, coin 9 representing an inserted coin, coin 10 representing a coin at the flap-shaped coin switch 7, coin 11 representing an accepted coin and coin 12 representing a returned coin. The returned coin 12 can be counterfeit, can have been not recognized by the measuring system or can be a follow-up coin, i.e. a coin that has been inserted too closely to another one. When the coin is recognized as genuine, the flap-shaped coin switch 7 is brought into a position in which an acceptance channel 13 is freed, through which a coin 11 falls into a cash box. If the inserted coin 9, 10 is not recognized by the system or is recognized as counterfeit, the flap-shaped coin switch 7 pivots into a position which closes the acceptance channel 13 and frees a return channel 14, through which the coin 12 reaches the exterior again. The return of the coin 12 is represented in FIG. 4. The runway 17 of the return channel 14 is composed of segments of differing inclination which are larger in the region of the coin switch 7, e.g. can lie at between 10° and 25° and otherwise between 5° and 10° to the horizontal. Shortly before the coin impact region, a coin retaining edge is provided which prevents an unintentional return thrust of the coin.

The functioning of the flap-shaped coin switch 7 and the return process are now to be explained in greater detail below with the aid of FIGS. 4 and 6 to 8. Coin 10 in FIG. 4 is a coin which is to be returned and the coin switch 7 is located in the position closing the acceptance channel 13. This position corresponds also to FIG. 6 in which the coin entry channel 5 is indicated by arrow 15. As can be recognized, the flap-shaped coin switch 7 has an extension 16 inclined sloping towards the runway 17 of the return channel 14, i.e. with respect to the vertical downwards in the direction of the runway 17, for example, at an angle of between 30° and 60°, preferably between 40° and 50° to the vertical. A portion of the runway 17 is integrally molded onto the coin switch 7. According to FIG. 6*b*, the coin is inclined towards the right, i.e. the coin has an angle to the horizontal of less than 90°.

Figure 7D:
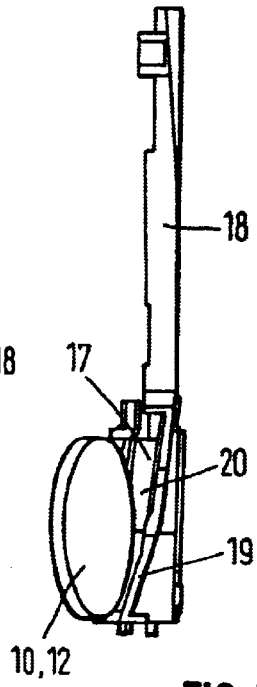
Figure 7C:
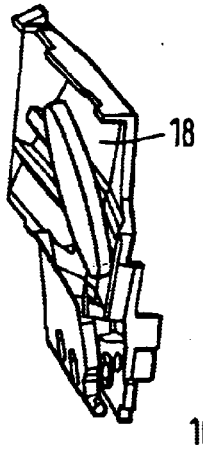
Figure 7A:
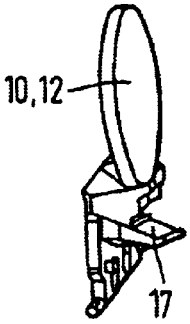
Figure 7B:
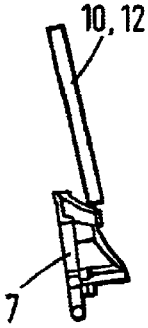
Figure 8D:
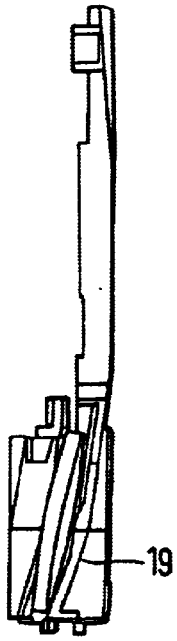
Figure 8C:
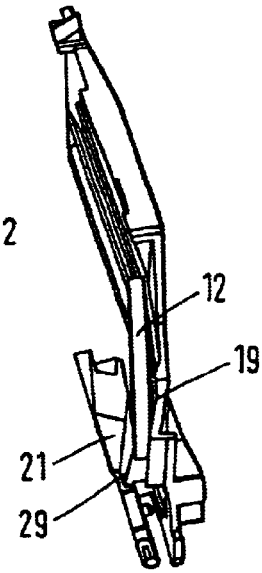
Figure 8A:
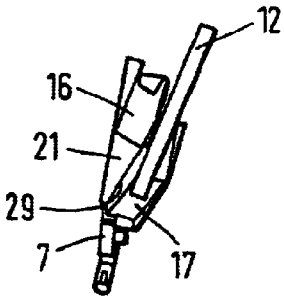
Figure 8B:
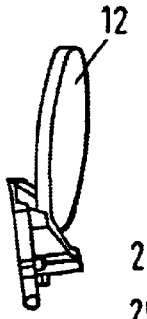

In FIGS. 7*a* to 7*d*, the coin 10, 12 is represented in a second position, and it can be recognised that the inclination has altered. The reason for this is that the coin 10, 12 slides away down the slope at its contact point with the inclined extension 16 of the coin switch 7, such that it alters its inclination, i.e. the coin has in comparison with FIG. 6 an inclination of >90° to the horizontal. This can be easily recognized in FIGS. 7*a* and 7*b*. In FIGS. 7*c* and 7*d*, the coin 10, 12 is represented in a perspective view with the coin switch 7 and the back wall 18 or boundary wall of the return channel 14, and in plan view of the back wall 18. The runway 17 is inclined in steps or continuously in the running direction of the coin and the back wall 18 has over the predominant portion of the return channel 14 ribs, on which the coin 12 is supported and which prevent sticking (FIGS. 7*c*, 8*c*). FIGS. 8*a* to 8*d* show a further position of coin 12, specifically in the moment in which it is located on the runway 17 (see also FIG. 4). Here it again has an inclination which is different from FIG. 7, this inclination being caused as a result of the boundary wall 19 of the return channel in the region of segment 20 of the return channel 14 in which the flap-shaped coin switch 7 is located. The boundary wall 19 is here configured inclined or wedge-shaped or slightly curved, specifically in the movement direction of the coin 12. The alteration of the inclination of the coin 12 is moreover supported by the shape of the inclined extension 16 of the coin switch 7, which extension 16 has a wedge-shaped segment 21. In this manner, the sloping extension 16, 21 and boundary walls 19, 29 of segment 20 of the return channel 14, configured inclined, wedge-shaped or curved, form a deflection device through which the direction of the coin or the inclination of the coin is altered in such a way that the "dead point" is overcome. Segment 20 of the return channel 14 thus lies at an angle to the remaining return channel 14. Through the double deflection, the coin does not stop or remain jammed and slides and rolls away at a substantially uniform speed and with a fluent movement from the inclined extension down the runway with a slight inclination in the running direction.

As can be seen from FIG. 2, the coin entry channel 5 is covered by the covering flap 3, which can be flapped away completely, in this embodiment at least at an angle of 90°. The covering flap 3, as FIGS. 1 and 2 show, is held closed by a long stretched-out wire spring 30. The spring 30 has at its one end a U-shaped bend 22, which can be laid at two points in recesses of extensions 23, and the end of which can be fixed by a snap-in lug 24. Through this measure, i.e. fixing by means of the extensions 23, the spring is secured against twisting and the snap-in lug 24 secures the end of the spring 30 against traction or pressure. A further extension 25 in the central region of the spring 30 predetermines the actual spring path and at the fastening end the spring has a clip 26 which grips at least partially over a projection 37 on the covering flap and fixes the latter in position. The one end of the U-shaped clip 26 is bent slightly upwards; by pulling the clip 26 downwards (FIG. 2) the spring can be pulled away from the projection 37, such that the maintenance person can open the flap 3 to clean the measurement system and the coin entry channel 5.

Figure 5:
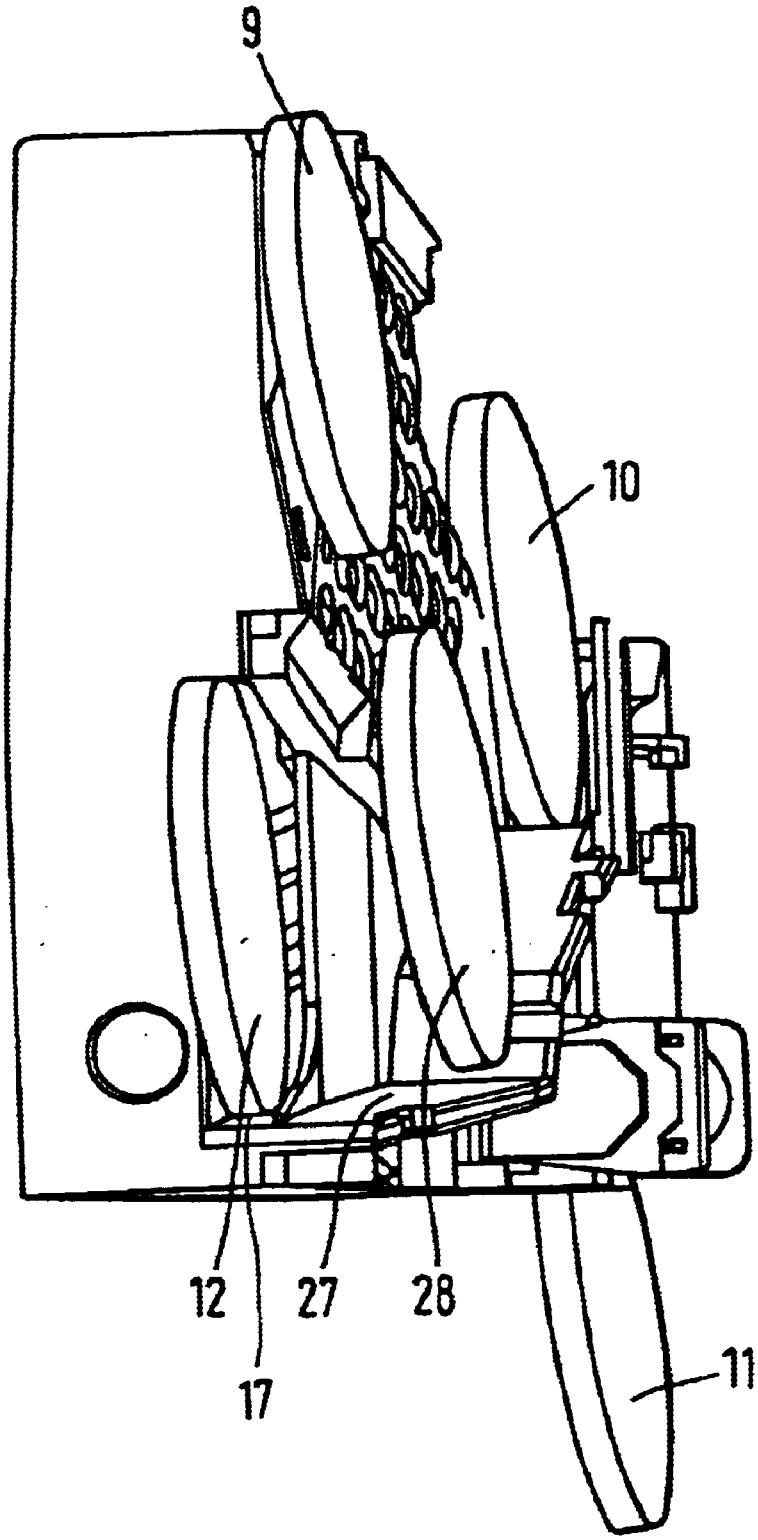
Figure 6A:
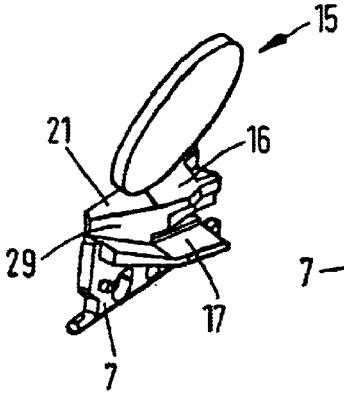
Figure 6B:
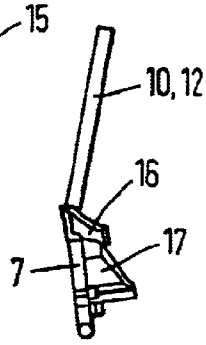

The covering flap 3 can, if the coin entry channel 5 is blocked, be easily raised from the exterior against the force of the spring 30. For this purpose an opening slope is provided on the front side of the flap. An opening button is secured to the front plate of the coin checker with a leaf spring and grips through the front plate, being provided with a slope corresponding to the opening slope of the flap. When the button is pressed, the slopes come into contact and the hinge opens in the normal direction, in such a way that a gap of roughly 4 mm is produced between the flap and the running surface. If the covering flap 3 is raised slightly, the coins which have jammed in the coin entry channel 5, slide downwards and run on a runway 27 according to FIG. 3 or an additional return channel parallel to return channel 14. Such a jammed coin is given the reference number 28 in FIG. 3. A corresponding front elevation is shown in FIG. 5.

Figure 9:
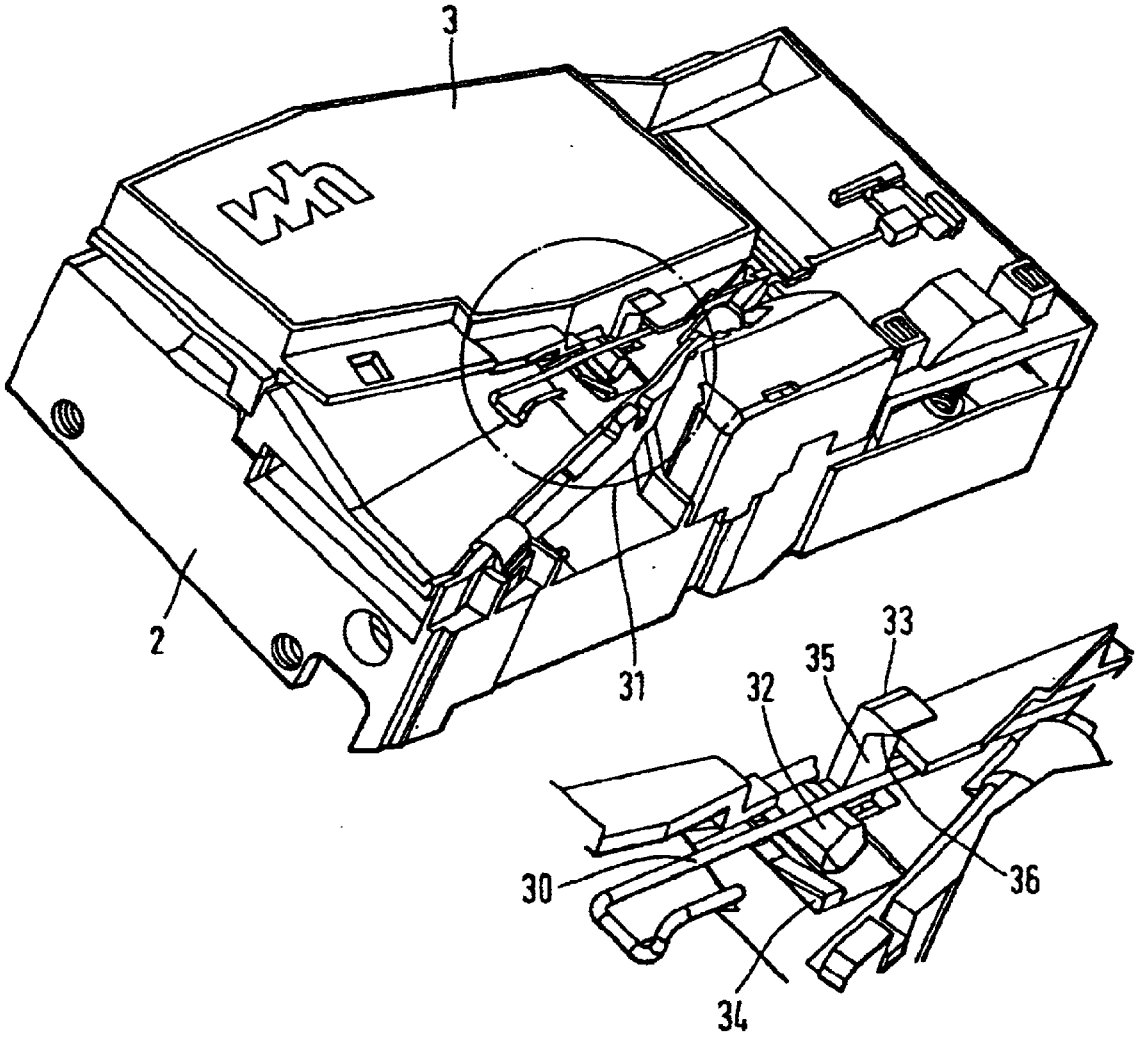

FIG. 9 is a perspective view of the coin checker similar to FIG. 2, but in the closed state, another embodiment of the closing and opening mechanism of the flap 3 for the spring 30 being shown. Here the mechanism, just as in FIG. 2, permits partial opening of flap 3 to remove jammed coins and complete opening for cleaning purposes.

The part of the opening and closing mechanism designated by the circle 31 is represented in enlargement. Flap 3 has an extension 32, which is gripped by the spring 30 under tension and closes the flap. Furthermore, adjacent to extension 32 in the closed state are provided a spring ejector 33 and a wedge-shaped auxiliary slope 34 which are securely connected to the base 2. For partial opening of the flap to return jammed coins, as described above, a return button is actuated from outside, through which a spring path is predetermined i.e. the spring 30 is raised by the extension 32 and slides on a surface 35, disposed perpendicular to the base 2, of the spring ejector 33, the height of this surface being adapted to the spring path predetermined by the return button. If the flap 3 is to be completely opened by an operator who has access to the coin checker, through the opening movement the spring wire 30 is displaced along a wedge-shaped inclined surface 36, which communicates with the perpendicular surface 35, until the spring 30 springs over the extension 32.

To close the flap 3, the extension 32 also has a runaway slope which faces the base 2 in the closed state. This run-away slope presses the spring wire 30 in the direction towards the wedge-shaped auxiliary slope 34, which in turn raises the spring wire and lets it snap over extension 32. In this manner, reliable opening and closing is guaranteed.

A coin checker according to FIG. 1 has for example at the front end face a height of 80 mm and a depth of approximately 115 to 116 mm. This coin checker can be used for coins up to 33 mm. The ratio of the depth to the height is generally greater than 1 and lies preferably between 1.4 and 1.5.

The inventive electronic coin checker is designed to be used instead of a mechanical coin checker built-in in a coin operated machine or appliance, like a vending machine or a washing machine. Such mechanical coin checkers often are provided to receive only one sort of coins, for example a quarter of a dollar. The presence of a coin is detected by the mechanical coin checker using a microswitch or a light emitting and receiving device like a light barrier. The signals of the microswitch or the light emitting and receiving device are sent via electric conductors or line to a control unit, which is provided in the coin operated machine.

The control unit controls the machine and/or the coin checker dependent on the amount of coins detected by the microswitch or the light barrier. When installing the mechanical coin checker into the coin operated machine the electric lines of the coin checker and the control unit are connected to each other via an electric interface like a plug connection.

The electric coin checker of the invention which is used instead of such a mechanical coin checker is designed to have an electric interface which is compatible to the interface of the mechanical coin checker so that no electrical and/or mechanical changes have to be made for the coin operated machine. The electric coin checker has therefore means which simulate the microswitch and/or the light barrier of the mechanical coin checker. Namely the output of the microswitch is substituted by the output of a potential free solid state relay which is included in the electric coin checker. The coins are checked in the electric coin checker by a sensor arrangement which is connected to a control device including a microprocessor or microcomputer controlling the means for guiding the detected coins in the appropriate way. According to the invention the control device controls the relay having the switching output according to the microswitch of the mechanical coin checker.

In similar manner the light barrier of the mechanical coin checker is simulated by an optocoupling device containing an output transistor, which is controlled by the control device of the electric coin checker.

A mechanical coin checker has a closing device of the coin slot in order to prevent coins being inserted for example when the coin operated machine is working. In that case an electromagnetic device receives an electric signal from the machine to activated the closing device. In the electric coin checker an optocoupling device may be provided the input of which receives the signal from the machine and which is designed to be connected to the control lines for the slot closing device.

Since the electronic coin checker accepts coins of different sorts or kinds, it is useful to transform the signal of coins of higher values, for example one dollar, into sequential pulse signals, each pulse signal indicating the acceptance of a coin of a smaller value, for example a quarter of a dollar to the control unit of the machine. This transformation may be made by the control device of the checker.

Since the electronic coin checker needs a different power supply in comparison to the mechanical coin checker it may be necessary to install a rectifying circuit and a switching regulator into the electric coin checker to provide it with the necessary voltages.

All these above mentioned measures are taken in order to make it possible to replace a mechanical coin checker by the inventive electric coin checker without the necessity to change the connections i.e. the interface or input/output means of the coin operated machine.

What is claimed is:

1. An electronic coin checker, comprising:

a coin entry channel operable to receive a coin;

a flap-shaped coin switch positioned at an end of the coin entry channel; and a control device for the flap-shaped coin switch, the control device controlling the coin switch to receive a coin running through the coin entry channel and to direct the coin into one of an acceptance channel accepting the coin and a return channel rejecting the coin in response to signals generated in the coin entry channel, the signals responsive to the coin, wherein the flap-shaped coin switch has a sloping extension inclined towards a runway of the return channel such that when the flap-shaped coin switch is in a return position, the coin slides down the sloping extension, altering an angle of inclination of the coin with respect to a direction of travel of the coin and the coin falls onto the runway of the return channel, and wherein a boundary wall of the return channel opposite the flap-shaped coin switch is configured so that a further alteration in the angle of inclination of the coin takes place.

2. The electronic coin checker according to claim 1, wherein a surface of the flap-shaped coin switch below the sloping extension is inclined with respect to a longitudinal direction of the return channel such that the return channel has a first segment and a second segment, the first segment lying in a region of the flap-shaped coin switch, and wherein boundary walls of the first segment are disposed at an angle to boundary walls of the second segment.

3. The electronic coin checker according to claim 2, wherein a runway of the first segment of the return channel is integrally molded onto the coin switch below the sloping extension.

4. The electronic coin checker according to claim 1, wherein a depth of the coin checker is greater than a height of the coin checker.

5. The electronic coin checker according to claim 4, wherein the ratio of the depth to the height lies between 1.4 and 1.5.

6. The electronic coin checker according to claim 1, wherein the coin entry channel is a component of a pivotable flap, a swivel axis of the flap lying above the coin entry channel.

7. The electronic coin checker according to claim 6, wherein the flap is fixed by means of a spring, the resilience of which permits the flap to be raised, producing a gap for removing blockages.

8. The electronic coin checker according to claim 1, wherein a further return channel is provided to return jammed coins, the further return channel parallel to a section of the return channel.

9. The electronic coin checker according to claim 1, further comprising:

a coin slot into the coin entry channel; and an exit from the return channel, wherein the coin slot and the exit are disposed on the end front surface.

10. An electronic coin checker, comprising:

a coin entry channel operable to receive a coin;

a flap-shaped coin switch positioned at an end of the coin entry channel; and a control device for the flap-shaped coin switch, the control device controlling the coin switch to receive a coin running through the coin entry channel and to direct the coin into one of an acceptance channel accepting the coin and a return channel rejecting the coin in response to signals generated in the coin entry channel, the signals responsive to the coin, wherein the flap-shaped coin switch has a sloping extension inclined towards a runway of the return channel such that when the flap-shaped coin switch is in a return position, the coin slides down the sloping extension, altering an angle of inclination of the coin with respect to a direction of travel of the coin and the coin falls onto the runway of the return channel, and wherein a boundary wall of the return channel opposite the flap-shaped coin switch is configured so that a further alteration in the angle of inclination of the coin takes place, and wherein the coin entry channel is a component of a pivotable flap, a swivel axis of the flap lying above the coin entry channel, and the flap is fixed by means of a spring, the resilience of which permits the flap to be raised, producing a gap for removing blockages, and wherein the spring is configured as a long stretched-out spring wire fixed in an interlocking manner at its one end against twisting and traction and pressure, the other end of which can be brought into engagement in an interlocking manner with an extension on the flap, the engagement able to be detached by bending the spring perpendicular to its longitudinal axis.

11. The electronic coin checker according to claim 10, further comprising:

means for supporting and guiding the spring wire as the flap is opened and closed.

12. An electronic coin checker, comprising:

a coin entry channel operable to receive a coin and to generate signals responsive to the coin;

a flap-shaped coin switch positioned at an end of the coin entry channel, the flap-shaped coin switch switchable between a first position and a second position;

a control device for switching the flap-shaped coin switch, the control device controlling the coin switch to direct the coin into one of an acceptance channel accepting the coin and a return channel rejecting the coin, the control device operable to control the coin switch in response to the signals;

a first runway of the return channel positioned to receive the coin if the coin reaches the flap-shaped coin switch and the flap-shaped coin switch is in the first position; and a second runway positioned to receive the coin if the coin jams in the coin entry channel, at least apart of the second runway in parallel with the first runway.

13. The electronic coin checker of claim 12, wherein the second runway is part of the return channel.

14. The electronic coin checker of claim 12, wherein the coin falls into the acceptance channel if the coin reaches the flap-shaped coin switch and the flap-shaped coin switch is in the second position.

15. The electronic coin checker of claim 12, wherein the first runway of the return channel comprises a plurality of runway segments, each of the plurality of runway segments having a downward inclination in a direction of travel of the coin; and wherein the downward inclination of each of the plurality of runway segments is one of between 10 degrees and 25 degrees and between 5 degrees and 10 degrees.

16. The electronic coin checker of claim 12, wherein the first runway of the return channel comprises a plurality of runway segments and wherein at least one surface of a first runway segment of the plurality of runway segments is integrally molded to the flap-shaped coin switch.

17. The electronic coin checker of claim 16, wherein the first runway segment of the plurality of segments has boundary walls at an angle to boundary walls of an adjacent runway segment.

18. The electronic coin checker of claim 16, wherein the flap-shaped coin switch has a sloping extension inclined towards the first runway segment such that when the flap-shaped coin switch is in the first position, the coin slides down the sloping extension, altering an angle of inclination of the coin, with respect to a direction of travel of the coin before falling into the first runway segment.

19. The electronic coin checker of claim 18, wherein the angle of inclination of the coin changes in the first runway segment.

20. The electronic coin checker of claim 18, wherein the first runway segment has a downward inclination in the direction of travel of the coin of between 10 degrees and 25 degrees and remaining runway segments of the plurality of runway segments have a downward inclination in the direction of travel of the coin and wherein the downward inclination for each of the remaining runway segments is one of between 10 degrees and 25 degrees and between 5 degrees and 10 degrees.

21. The electronic coin checker of claim 20, wherein the sloping extension is a wedge-shaped section forming one boundary wall of the first runway segment and wherein at least one of the one boundary wall of the first runway segment and a second boundary wall of the first runway segment is angled with respect to boundary walls of an adjacent runway segment of the plurality of runway segments.

22. An electronic coin checker, comprising;

a coin entry channel operable to receive a coin and to generate signals responsive to the coin;

a flap-shaped coin switch positioned at an end of the coin entry channel, the flap-shaped coin switch switchable between a first position and a second position;

a control device for switching the flap-shaped coin switch, the control device controlling the coin switch to direct the cot into one of an acceptance channel accepting the coin and a return channel rejecting the coin, the control device operable to control the coin switch in response to the signals;

a first runway of the return channel positioned to receive the coin if the coin reaches the flap-shaped coin switch and the flap-shaped coin switch is in the first position, the first runway comprising a plurality of runny segments wherein a first runway segment of the plurality of runway segments is adjacent the flap-shaped coin switch and has boundary walls at an angle to boundary walls of an adjacent runway segment of the plurality of runway segments; and a coin slot of the coin entry channel one of above the coin entry channel and to a first side of the coin entry channel, the return channel exiting below the first side of the coin entry channel, wherein a coin inserted in the coin slot proceeds through the coin entry channel in a first direction of travel, the coin changing to a second direction of travel as the first runway receives the coin from the flap-shaped coin switch; and wherein a depth of the coin checker is greater than a height of the coin checker.

23. The electronic coin checker according to claim 22, wherein a ratio of the depth to the height lies between 1.4 and 1.5.

24. The electronic coin checker of claim 22, wherein at least one suite of the first runway segment of the plurality of runway segments is integrally molded to the flap-shaped coin switch.

25. The electronic coin checker of claim 4, wherein the first runway segment has a downward inclination in a direction of travel of the coin of between 10 degrees and 25 degrees and each remaining runway segment of the plurality of runway segments has a downward inclination in the direction of travel of the coin and wherein the downward inclination for each remaining runway segment is one of between 10 degrees and 25 degrees and between 5 degrees and 10 degrees.

26. The electronic coin checker of claim 22, further comprising a second runway positioned to receive the coin if the coin jams in the coin entry channel, at least a part of the second runway in parallel with the first runway.

27. The electronic coin checker of claim 22, wherein the coin falls into the acceptance channel if the coin reaches the flap-shaped coin switch and the flap-shaped coin switch is in the second position.

* * * * *